US009957588B2

(12) United States Patent
Chen et al.

(10) Patent No.: US 9,957,588 B2
(45) Date of Patent: May 1, 2018

(54) ALUMINUM-ZIRCONIUM-TITANIUM-CARBON GRAIN REFINER AND METHOD FOR PRODUCING THE SAME

(71) Applicant: Shenzhen Sunxing Light Alloys Materials Co., Ltd., Shenzhen, Guangdong (CN)

(72) Inventors: Xuemin Chen, Guangdong (CN); Qingdong Ye, Guangdong (CN); Yueming Yu, Guangdong (CN); Jianguo Li, Guangdong (CN)

(73) Assignee: SHENZHEN SUNXING LIGHT ALLOYS MATERIALS CO., LTD., Shenzhen, Guangdong (CN)

( * ) Notice: Subject to any disclaimer, the term of this patent is extended or adjusted under 35 U.S.C. 154(b) by 0 days. days.

(21) Appl. No.: 14/521,569

(22) Filed: Oct. 23, 2014

(65) Prior Publication Data

US 2015/0041095 A1 Feb. 12, 2015

Related U.S. Application Data

(62) Division of application No. 13/254,533, filed as application No. PCT/CN2011/077428 on Jul. 21, 2011.

(30) Foreign Application Priority Data

Jun. 10, 2011 (CN) ..... 2011 1 0155832

(51) Int. Cl.

| | |
|---|---|
| ***B22D 27/20*** | (2006.01) |
| ***C22C 1/02*** | (2006.01) |
| ***C22C 21/00*** | (2006.01) |

(52) U.S. Cl.

CPC ..... *C22C 1/026* (2013.01); *B22D 27/20* (2013.01); *C22C 1/02* (2013.01); *C22C 21/00* (2013.01)

(58) Field of Classification Search

CPC ..... C22C 21/00; C22C 1/02; C22C 1/026; B22D 27/20

USPC ..... 148/437, 438; 164/57.1; 420/537, 538, 420/550, 552

See application file for complete search history.

(56) References Cited

U.S. PATENT DOCUMENTS 4,612,073 A * 9/1986 Guzowski et al. ..... 148/415

* cited by examiner

*Primary Examiner* — Brian Walck

(74) *Attorney, Agent, or Firm* — Jackson IPG PLLC; Demian K. Jackson

(57) ABSTRACT

The present invention pertains to the field of metal alloy, and discloses an aluminum-zirconium-titanium-carbon grain refiner for magnesium and magnesium alloys, having a chemical composition of: 0.01%~10% Zr, 0.01%~10% Ti, 0.01%~0.3% C, and Al in balance, based on weight percentage. Also, the present invention discloses the method for preparing the grain refiner. The grain refiner according to the present invention is an Al—Zr—Ti—C intermediate alloy having great nucleation ability and in turn excellent grain refining performance for magnesium and magnesium alloys, and is industrially applicable in the casting and rolling of magnesium and magnesium alloy profiles, enabling the wide use of magnesium in industries.

9 Claims, 2 Drawing Sheets

ALUMINUM-ZIRCONIUM-TITANIUM-CARBON GRAIN REFINER AND METHOD FOR PRODUCING THE SAME

FIELD OF THE INVENTION

The present invention relates to an intermediate alloy for improving the performance of metals and alloys by refining grains, and, especially, to a grain refiner for magnesium and magnesium alloy and the method for producing the same.

BACKGROUND OF THE INVENTION

The use of magnesium and magnesium alloy in industries started in 1930s. Since magnesium and magnesium alloys are the lightest structural metallic materials at present, and have the advantages of low density, high specific strength and stiffness, good damping shock absorption, heat conductivity, and electromagnetic shielding performance, excellent machinability, stable part size, easy recovery, and the like, magnesium and magnesium alloys, especially wrought magnesium alloys, possess extremely enormous utilization potential in the filed of transportation, engineering structural materials, and electronics. Wrought magnesium alloy refers to the magnesium alloy formed by plastic molding methods such as extruding, rolling, forging, and the like. However, due to the constraints in, for example, material preparation, processing techniques, anti-corrosion performance and cost, the use of magnesium alloy, especially wrought magnesium alloy, is far behind steel and aluminum alloys in terms of utilization amount, resulting in a tremendous difference between the developing potential and practical application thereof, which never occurs in any other metal materials.

The difference of magnesium from other commonly used metals such as iron, copper, and aluminum lies in that, its alloy exhibits closed-packed hexagonal crystal structure, has only 3 independent slip systems at room temperature, is poor in plastic wrought, and is significantly affected by grain sizes in terms of mechanical property. Magnesium alloy has relatively wide range of crystallization temperature, relatively low heat conductivity, relatively large volume contraction, serious tendency to grain growth coarsening, and defects of generating shrinkage porosity, heat cracking, and the like during setting. Since finer grain size facilitates reducing shrinkage porosity, decreasing the size of the second phase, and reducing defects in forging, the refining of magnesium alloy grains can shorten the diffusion distance required by the solid solution of short grain boundary phases, and in turn improves the efficiency of heat treatment. Additionally, finer grain size contributes to improving the anti-corrosion performance and machinability of the magnesium alloys. The application of grain refiner in refining magnesium alloy melts is an important means for improving the comprehensive performances and forming properties of magnesium alloys. The refining of grain size can not only improve the strength of magnesium alloys, but also the plasticity and toughness thereof, thereby enabling large-scale plastic processing and low-cost industrialization of magnesium alloy materials.

It was found in 1937 that the element that has significantly refining effect for pure magnesium grain size is Zr. Studies have shown that Zr can effectively inhibits the growth of magnesium alloy grains, so as to refine the grain size. Zr can be used in pure Mg, Mg—Zn-based alloys, and Mg-RE-based alloys, but can not be used in Mg—Al-based alloys and Mg—Mn-based alloys, since it has a very small solubility in liquid magnesium, that is, only 0.6 wt % Zr dissolved in liquid magnesium during peritectic reaction, and will be precipitated by forming stable compounds with Al and Mn. Mg—Al-based alloys are the most popular, commercially available magnesium alloys, but have the disadvantages of relatively coarse cast grains, and even coarse columnar crystals and fan-shaped crystals, resulting in difficulties in wrought processing of ingots, tendency to cracking, low finished product rate, poor mechanical property, and very low plastic wrought rate, which adversely affects the industrial production thereof. Therefore, the problem existed in refining magnesium alloy cast grains should be firstly addressed in order to achieve large-scale production. The methods for refining the grains of Mg—Al-based alloys mainly comprise overheating method, rare earth element addition method, and carbon inoculation method. The overheating method is effective to some extent; however, the melt is seriously oxidized. The rare earth element addition method has neither stable nor ideal effect. The carbon inoculation method has the advantages of broad source of raw materials and low operating temperature, and has become the main grain refining method for Mg—Al-based alloys. Conventional carbon inoculation methods add $MgCO_3$, $C_2Cl_6$, or the like to a melt to form large amount of disperse $Al_4C_3$ mass points therein, which are good heterogeneous crystal nucleus for refining the grain size of magnesium alloys. However, such refiners are seldom adopted because their addition often causes the melt to be boiled. In summary, in contrast with the industry of aluminum alloys, a general-purpose grain intermediate alloy has not been found in the industry of magnesium alloy, and the applicable range of various grain refining methods depends on the alloys or the components thereof. Therefore, one of the keys to achieve the industrialization of magnesium alloys is to find a general-purpose grain refiner capable of effectively refining cast grains when solidifying magnesium and magnesium alloys.

SUMMARY OF THE INVENTION

For the purpose of addressing the disadvantages existing in the above prior art, the present invention provides an aluminum-zirconium-titanium-carbon intermediate alloy for refining the grains of magnesium and magnesium alloys, which has great nucleation ability for magnesium and magnesium alloys. Also, the present invention provides a method for producing the intermediate alloy.

Surprisingly, the present inventor found that both $Al_4C_3$ and ZrC possess nucleation ability, and ZrC is a crystal nucleus having nucleation ability as many times as that of the $Al_4C_3$ in large number of studies on the refining of magnesium alloy grains. However, both $Al_4C_3$ and ZrC are not easy to be obtained. The present inventor readily prepared an Al—Zr—Ti—C intermediate alloy, in which large amount of $mAl_4C_3.nZrC.pTiC$ particle agglomerate were observed in the gold phase via scanning electromicroscopic diagram and energy spectrum analysis. The obtained Al—Zr—Ti—C intermediate alloy has relatively low melting point, so that it can form large amount of disperse ZrC and $Al_4C_3$ mass points, acting as the best non-homogeneous crystal nucleus for magnesium alloys.

The present invention adopts the following technical solutions: An aluminum-zirconium-titanium-carbon grain refiner for magnesium and magnesium alloys has a chemical composition of: 0.01%~10% Zr, 0.01%~10% Ti, 0.01%~0.3% C, and Al in balance, based on weight percentage.

Preferably, the aluminum-zirconium-titanium-carbon (Al—Zr—Ti—C) intermediate alloy has a chemical composition of: 0.1%~10% Zr, 0.1%~10% Ti, 0.01%~0.3% C, and Al in balance, based on weight percentage. The more preferable chemical composition is: 1%~5% Zr, 1%~5% Ti, 0.1%~0.3% C, and Al in balance.

Preferably, the contents of impurities present in the aluminum-zirconium-titanium-carbon (Al—Zr—Ti—C) intermediate alloy are: Fe≤0.5%, Si≤0.3%, Cu≤0.2%, Cr≤0.2%, and other single impurity element≤0.2%, based on weight percentage.

A method for producing an aluminum-zirconium-titanium-carbon grain refiner for magnesium and magnesium alloys according to the present invention comprises the steps of:

1. preparing the above raw materials according to their weight percentage, melting commercially pure aluminum, heating to a temperature of 1000° C.-1300° C., and adding zirconium scrap, titanium scrap and graphite powder thereto to be dissolved therein, and
2. keeping the temperature under agitation for 15-120 minutes, and performing casting molding.

The present invention achieves the following technical effects: an Al—Zr—Ti—C intermediate alloy which has great nucleation ability and in turn excellent ability in refining the grains of magnesium and magnesium alloys is invented, in which large amount of $mAl_4C_3.nZrC.pTiC$ particle agglomerate are present, wherein m:n:p is about (0.6~0.75):(0.1~0.2):(0.1~0.2). The obtained intermediate alloy can form large amount of disperse ZrC and $Al_4C_3$ mass points acting as nucleus, greatly facilitating the grain refining of magnesium or magnesium alloy microstructure. It has good wrought processing performance, and can be easily rolled into a wire material of φ9~10 mm for industrial production. As a grain refiner, the intermediate alloy is industrially applicable in the casting and rolling of magnesium and magnesium alloy profiles, enabling the wide use of magnesium in industries.

DETAILED DESCRIPTION

The present invention can be further clearly understood in combination with the particular examples given below, which, however, are not intended to limit the scope of the present invention.

Example 1

Figure 1:
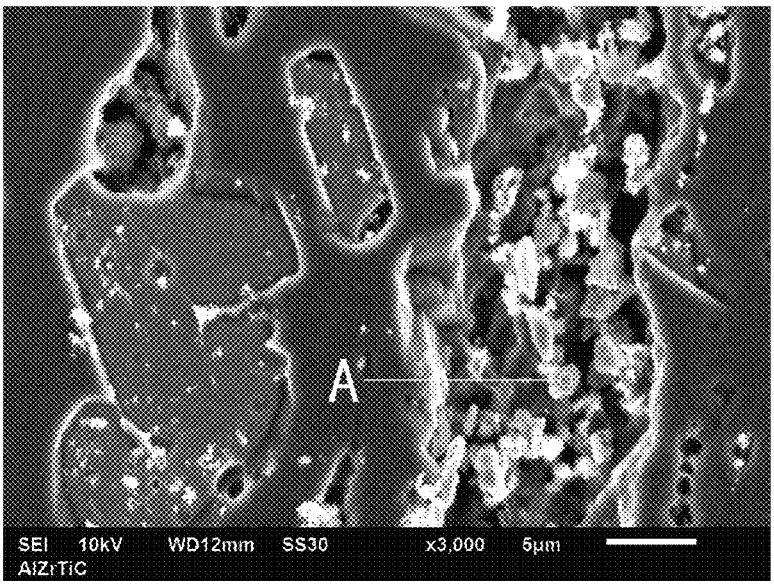
FIG. 1 is the SEM calibration graph of Al—Zr—Ti—C intermediate alloys magnified by 3000.

948.5 kg commercially pure aluminum (Al), 30 kg zirconium (Zr) scrap, 20 kg titanium (Ti) scrap and 1.5 kg graphite powder were weighed. The aluminum was added to an induction furnace, melt therein, and heated to a temperature of 1050° C.±10° C., in which the zirconium scrap, the titanium scrap and the graphite powder were then added and dissolved. The resultant mixture was kept at the temperature under mechanical agitation for 100 minutes, and directly cast into Waffle ingots, i.e., aluminum-zirconium-titanium-carbon (Al—Zr—Ti—C) intermediate alloy. FIG. 1 shows the SEM photographs of Al—Zr—Ti—C intermediate alloy at 3000 magnification, in which the gray blocks are larger particles, having a particle size of 20 μm~100 μm; and the polygonal thin sheets are smaller particles, having a particle size of 1~10 μm.

Figure 2:
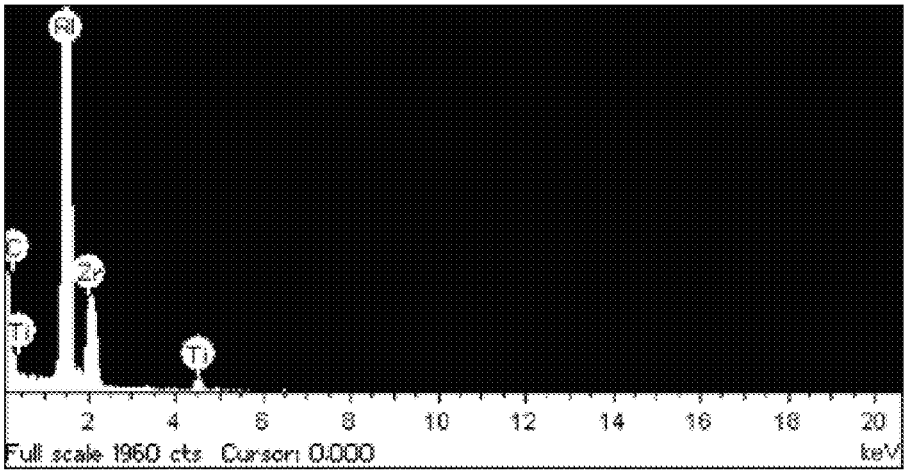
FIG. 2 is the energy spectrum of point A in FIG. 1.

FIG. 2 is an energy spectrum of A area in FIG. 1. The standard samples used in the test were $Al:Al_2O_3$; Zr:Zr; Ti:Ti; $C:CaCO_3$, and Zr:Zr, and the atom percentages were 51.56% C, 37.45% Al, 7.52% Zr and 3.47% Ti, respectively.

Example 2

942.3 kg commercially pure aluminum (Al), 45 kg zirconium (Zr) scrap, 10 kg titanium (Ti) scrap and 2.7 kg graphite powder were weighed. The aluminum was added to an induction furnace, melt therein, and heated to a temperature of 1200° C.±10° C., in which the zirconium scrap, the titanium scrap and the graphite powder were then added and dissolved. The resultant mixture was kept at the temperature under mechanical agitation for 30 minutes, and directly cast into Waffle ingots, i.e., an aluminum-zirconium-titanium-carbon (Al—Zr—Ti—C) intermediate alloy.

Example 3

978 kg commercially pure aluminum (Al), 10 kg zirconium (Zr) scrap, 11 kg titanium (Ti) scrap, and 1 kg graphite powder were weighed. The aluminum was added to an induction furnace, melt therein, and heated to a temperature of 1100° C.±10° C., in which the zirconium scrap, the titanium scrap and the graphite powder were then added and dissolved. The resultant mixture was kept at the temperature under mechanical agitation for 45 minutes, and directly cast into Waffle ingots, i.e., an aluminum-zirconium-titanium-carbon (Al—Zr—Ti—C) intermediate alloy.

Example 4

972.6 kg commercially pure aluminum (Al), 25 kg zirconium (Zr) scrap, 1.4 kg titanium (Ti) scrap, and 1 kg graphite powder were weighed. The aluminum was added to an induction furnace, melt therein, and heated to a temperature of 1300° C.±10° C., in which the zirconium scrap, the titanium scrap and the graphite powder were then added and dissolved. The resultant mixture was kept at the temperature under mechanical agitation for 25 minutes, and directly cast into Waffle ingots, i.e., an aluminum-zirconium-titanium-carbon (Al—Zr—Ti—C) intermediate alloy.

Example 5

817 kg commercially pure aluminum (Al), 97 kg zirconium (Zr) scrap, 83 kg titanium (Ti) scrap, and 3 kg graphite powder were weighed. The aluminum was added to an induction furnace, melt therein, and heated to a temperature of 1270° C.±10° C., in which the zirconium scrap, the titanium scrap and the graphite powder were then added and dissolved. The resultant mixture was kept at the temperature under mechanical agitation for 80 minutes, and directly cast into Waffle ingots, i.e., an aluminum-zirconium-titanium-carbon (Al—Zr—Ti—C) intermediate alloy.

Example 6

997.5 kg commercially pure aluminum (Al), 1 kg zirconium (Zr) scrap, 1.2 kg titanium (Ti) scrap, and 0.3 kg graphite powder were weighed. The aluminum was added to an induction furnace, melt therein, and heated to a temperature of 1270° C.±10° C., in which the zirconium scrap, the titanium scrap and the graphite powder were then added and dissolved. The resultant mixture was kept at the temperature under mechanical agitation for 120 minutes, and cast and rolled into coiled wires of aluminum-zirconium-titanium-carbon (Al—Zr—Ti—C) intermediate alloy having a diameter of 9.5 mm.

Example 7

Pure magnesium was melt in an induction furnace under the protection of a mixture gas of $SF_6$ and $CO_2$, and heated to a temperature of 710° C., to which 1% Al—Zr—Ti—C intermediate alloy prepared according to examples 1-6 were respectively added to perform grain refining. The resultant mixture was kept at the temperature under mechanical agitation for 30 minutes, and directly cast into ingots to provide 6 groups of magnesium alloy sample subjected to grain refining.

The grain size of the samples were evaluated under GB/T 6394-2002 for the circular range defined by a radius of ½ to ¾ from the center of the samples. Two fields of view were defined in each of the four quadrants over the circular range, that is, 8 in total, and the grain size was calculated by cut-off point method.

Figure 3:
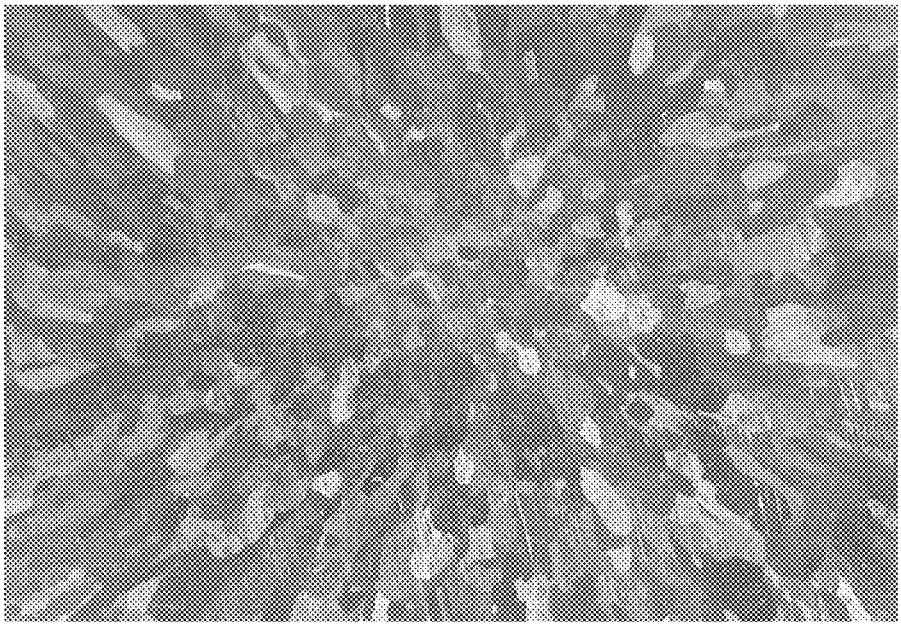
FIG. 3 is the grain microstructure of pure magnesium.
Figure 4:
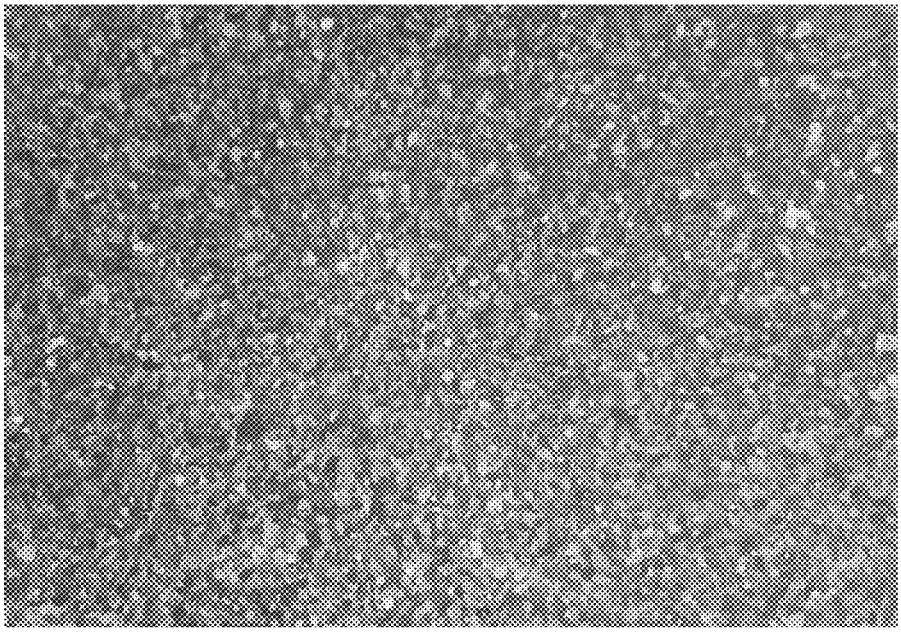
FIG. 4 is the grain microstructure of pure magnesium subjected to grain refining by the Al—Zr—Ti—C intermediate alloy.

Referring to FIG. 3, it shows the grain microstructure of pure magnesium without grain refining. The pure magnesium without grain refining exhibited columnar grains having a width of 300 μm~2000 μm and in scattering state. FIG. 4 shows the grain microstructure of pure magnesium subjected to grain refining. The 6 groups of magnesium alloys subjected to grain refining exhibited equiaxed grains with a width of 50 μm~200 μm.

The results of the tests show that the Al—Zr—Ti—C intermediate alloys according to the present invention have very good effect in refining the grains of pure magnesium.

The Al—Zr—Ti—C intermediate alloy has great nucleation ability and in turn excellent ability in refining the grains of magnesium and magnesium alloys. It has good wrought processing performance, and can be easily rolled into a wire material of φ9~10 mm for industrial production. As a grain refiner, the intermediate alloy is industrially applicable in the casting and rolling of magnesium and magnesium alloy profiles.

What is claimed is:

1. A method comprising the steps of:

a. melting commercially pure aluminum, heating to a temperature of 1000-1300 Celsius, and adding zirconium, titanium and graphite powder thereto to be dissolved therein, and b. keeping the temperature under agitation for 15-20 minutes, and performing casting molding to obtain an aluminum-zirconium-titanium-carbon (Al—Zr—Ti—C) intermediate alloy having dispersed ZrC and $Al_4C_3$ mass points and a chemical composition consisting of: 0.01%~10% Zr, 0.01%~10% Ti, 0.01%~0.3% C, and Al in balance, based on weight percentage.

2. A method comprising the steps of:

a. melting commercially pure aluminum, heating to a temperature of 1000-1300 Celsius, and adding zirconium, titanium and graphite powder thereto to be dissolved therein, and b. keeping the temperature under agitation for 15-20 minutes, and performing casting molding to obtain an aluminum-zirconium-titanium-carbon (Al—Zr—Ti—C) intermediate alloy having dispersed ZrC and $Al_4C_3$ mass points and a chemical composition consisting of: 0.1%~10% Zr, 0.1%~10% Ti, 0.01%~0.3% C, and Al in balance, based on weight percentage.

3. A method comprising the steps of:

a. melting commercially pure aluminum, heating to a temperature of 1000-1300 Celsius, and adding zirconium, titanium and graphite powder thereto to be dissolved therein, and b. keeping the temperature under agitation for 15-20 minutes, and performing casting molding to obtain an aluminum-zirconium-titanium-carbon (Al—Zr—Ti—C) intermediate alloy having dispersed ZrC and $Al_4C_3$ mass points and a chemical composition consisting of: 1%~5% Zr, 1%~5% Ti, 0.1%~0.3% C, and Al in balance, based on weight percentage.

4. The method of claim 1, wherein $mAl_4C_3.nZrC.pTiC$ particle agglomerates are present in the intermediate alloy wherein m:n:p is within the ranges (0.6-0.75):(0.1-0.2):(0.1-0.2) respectively.

5. The method of claim 2, wherein $mAl_4C_3.nZrC.pTiC$ particle agglomerates are present in the intermediate alloy wherein m:n:p is within the ranges (0.6-0.75):(0.1-0.2):(0.1-0.2) respectively.

6. The method of claim 3, wherein $mAl_4C_3.nZrC.pTiC$ particle agglomerates are present in the intermediate alloy wherein m:n:p is within the ranges (0.6-0.75):(0.1-0.2):(0.1-0.2) respectively.

7. The method of claim 1, further comprising:

c. melting pure magnesium under protection of a gas mixture of $SF_6$ and $CO_2$ and heating to 710° C.;

d. adding 1% of the Al—Zr—Ti—C intermediate alloy;

e. holding the magnesium and Al—Zr—Ti—C intermediate alloy mixture at 710° C. under agitation; and f. casting the magnesium and Al—Zr—Ti—C intermediate alloy mixture.

8. The method of claim 2, further comprising:

c. melting pure magnesium under protection of a gas mixture of $SF_6$ and $CO_2$ and heating to 710° C.;

d. adding 1% of the Al—Zr—Ti—C intermediate alloy;

e. holding the magnesium and Al—Zr—Ti—C intermediate alloy mixture at 710° C. under agitation; and f. casting the magnesium and Al—Zr—Ti—C intermediate alloy mixture.

9. The method of claim 3, further comprising:

c. melting pure magnesium under protection of a gas mixture of $SF_6$ and $CO_2$ and heating to 710° C.;

d. adding 1% of the Al—Zr—Ti—C intermediate alloy;

e. holding the magnesium and Al—Zr—Ti—C intermediate alloy mixture at 710° C. under agitation; and f. casting the magnesium and Al—Zr—Ti—C intermediate alloy mixture.

* * * * *